US009979077B2

(12) United States Patent
Wong et al.

(10) Patent No.: US 9,979,077 B2
(45) Date of Patent: May 22, 2018

(54) VEHICLE ANTENNA FOR SATELLITE COMMUNICATION

(71) Applicants: Gary Gwoon Wong, Torrance, CA (US); Hyman Gwoon Wong, Torrance, CA (US); Calvin Gwoon Wong, Torrance, CA (US); Perry Gwoon Wong, Torrance, CA (US); Kalem Gwoon Wong, Torrance, CA (US)

(72) Inventors: Gary Gwoon Wong, Torrance, CA (US); Hyman Gwoon Wong, Torrance, CA (US); Calvin Gwoon Wong, Torrance, CA (US); Perry Gwoon Wong, Torrance, CA (US); Kalem Gwoon Wong, Torrance, CA (US)

( * ) Notice: Subject to any disclaimer, the term of this patent is extended or adjusted under 35 U.S.C. 154(b) by 121 days.

(21) Appl. No.: 14/955,202

(22) Filed: Dec. 1, 2015

(65) Prior Publication Data

US 2017/0155197 A1 Jun. 1, 2017

Related U.S. Application Data

(60) Provisional application No. 62/092,192, filed on Dec. 15, 2014.

(51) Int. Cl.
*H01Q 1/32* (2006.01)
*H01Q 3/26* (2006.01)
(Continued)

(52) U.S. Cl.
CPC ..... *H01Q 1/32* (2013.01); *H01Q 3/26* (2013.01); *H01Q 21/20* (2013.01); *H01Q 21/24* (2013.01); *H01Q 21/26* (2013.01)

(58) Field of Classification Search
CPC .. H01Q 9/16; H01Q 1/12; H01Q 1/32; H01Q 1/523
(Continued)

(56) References Cited

U.S. PATENT DOCUMENTS

2003/0134592 A1* 7/2003 Franzen ..... H04B 7/2041 455/12.1
2005/0110699 A1* 5/2005 Timofeev ..... H01Q 1/245 343/797
(Continued)

*Primary Examiner* — Andrea Lindgren Baltzell

(57) ABSTRACT

This invention discloses a design and implementation of an X-band antenna optimized for a moving vehicle to communicate with a stationary orbit satellite. The new antenna design employs unique circuit boards that contain dipole elements, power dividers, pin diode switches and digital phase shifters. The circuit boards perform together as an array to produce high gain beams. Depending on the antenna performance needs, several antenna boards may be required. The circuit boards' dimensions are all identical containing round disks of equal diameters. The dipole radiating elements are located near the outer edge of the board. They are designed to perform circular type polarization. By increasing the diameter of the board and a number of boards, or a combination of the two, one can achieve any desired beam shape that may be required. The disclosure design approach is unique and flexible; for this reason, an eight circuit board vehicle antenna has been configured. The disclosure antenna body is a cylindrical shaped structure which is having a 4.25 inch in diameter and 8.50 inch in height. This design approach is also applicable to frequencies other than X-band. Outstanding characteristics of the disclosure antenna are high performance, rigid body and low cost.

8 Claims, 1 Drawing Sheet

Figure 2:
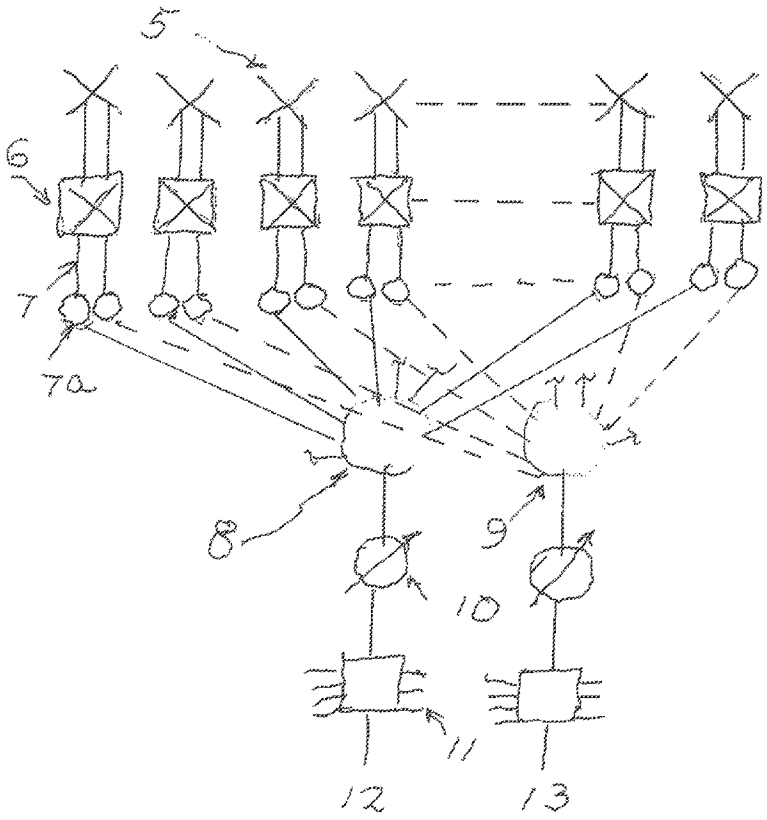

(51) Int. Cl.
*H01Q 21/20* (2006.01)
*H01Q 21/24* (2006.01)
*H01Q 21/26* (2006.01)

(58) Field of Classification Search
USPC ..... 343/797
See application file for complete search history.

(56) References Cited

U.S. PATENT DOCUMENTS

| | | | | |
|---|---|---|---|---|
| 2010/0117914 | A1* | 5/2010 | Feller | H01Q 1/42 343/757 |
| 2013/0201066 | A1* | 8/2013 | Parsche | H01Q 7/00 343/743 |
| 2017/0155197 | A1 | 6/2017 | Wong | |

* cited by examiner

VEHICLE ANTENNA FOR SATELLITE COMMUNICATION

CROSS-REFERENCE TO RELATED APPLICATION

This application claims the benefit of U.S. Provisional Application No. 62/092,172.

FIELD

This disclosure provides a new art in design and fabrication of a vehicle array antenna to forms in maintain communication with a stationery satellite while the vehicle is in motion.

DESIGN CONSIDERATION

From a design point of view, without mechanical pointing, a planner array approach would be prohibitively large and complex; a dome-shaped antenna aperture approach would require a very complex power divider and a complex phasing network. The physical size of a dome shaped antenna would be too large to be implemented. The cylindrical body shape, however, is the only structure that can be arrayed easily. Depending on the antenna gain performance needs, several antenna boards may be necessary.

The vehicle antenna design considerations for satellite communication are quite different from other non-satellite communication antenna. The vehicle antenna for satellite communication needs an omnidirectional coverage along the horizontal plane to cover the lateral motion of the vehicle. The elevation coverage is dictated by the location of the vehicle in its latitude position on the globe; therefore, a vehicle antenna pointing angle to the satellite is readily known. If the motion of the vehicle along the vertical plane is not excessive, the coverage changes due to a vehicle motion can be satisfied by the elevation pattern beam width of the antenna; the horizontal coverage is provided by the antenna elements that are excited.

DETAIL DESCRIPTION

A high gain beam is formed by narrowing the pattern coverage along the vertical and horizontal planes. This is accomplished by exciting rows and columns of elements that are visible to the communication satellite. Digital phase shifters are applied to obtain relative phases between circuit boards to point the antenna beam along the vertical direction. Pin diode switches are used to turn off the dipole elements that are not fully facing the satellite. The pin diode switches used to turn on/off antenna elements are located along the feed lines on the spoke-shaped power divider of the antenna circuit board.

There are many advantages of a cylindrical shaped-aperture due to its ability to accommodate the unique features of the circuit board.

Each circuit board is uniformly excited by a simple power divider through a digital phase shifter.

All circuit boards perform together as an array to produce high gain beams. A number of boards are arrayed together to provide the required antenna gain. The circuit boards' dimensions are all identical, containing round disks of equal diameters.

Antenna Radiating Module Design

A cylindrical body of 4.25 inches in diameter and 8.50 inches in height has been selected to be the preferred embodiment of the disclosure antenna envelope. There are sixteen broadband crossed dipole elements which are symmetrically located near the outer edge of each circuit board. The crossed dipole elements are individually fed by a 90 degree hybrid coupler, and the input ports of the hybrid coupler are connected to the respective left hand and right hand circular polarization circuits consisting of a pin diode switch, a power divider and a pin diode phase shifter.

The circuit boards are fabricated by etching techniques where the opposing circuits are etched onto the respective sides of the board; the entire circuit board is then excited by a simple coaxial cable. The top side of the board is connected to the center conductor of the coaxial cable while the bottom side is connected to the coaxial line's outer shield.

There are sixteen pairs of feed lines; half of the feed lines are etched on the top side while the opposing half etched on the bottom side of the board. These feed lines are symmetrically extended outward from the center of the board and are each connected to a diode switch. The diode switches are implemented to turn off the crossed dipole radiating elements that are not facing the satellite.

The diode switch location in each feed line is carefully positioned so that adequate isolation is obtained between the radiating elements. The pin diode phase shifters are operated to point the antenna beam to the desire elevation angle to the satellite.

For azimuth pointing, a reference signal is obtained from a compass to point the antenna beam continuously at the satellite while the vehicle is in motion. This is achieved by turning off the antenna elements that are not physically facing the communication satellite.

The disclosure antenna system will be implemented such that the entire system may be operated manually while the antenna is in a stationary position.

Antenna Enclosure

Figure 1:
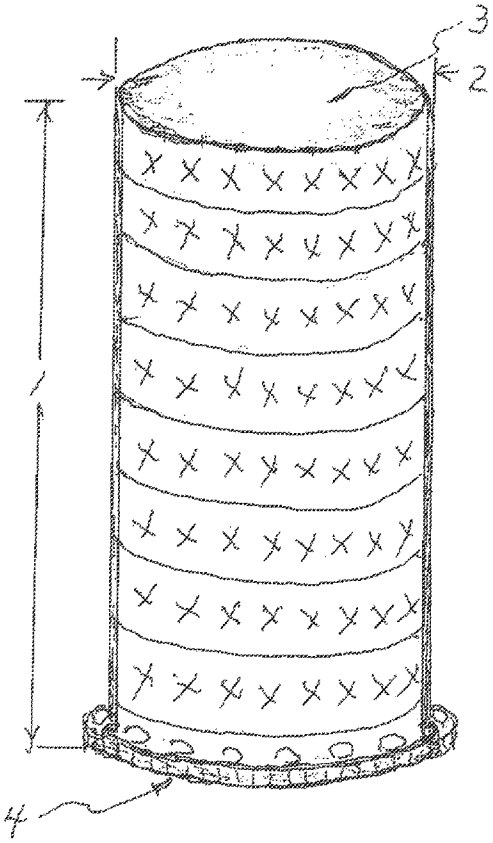

The FIG. 1 enclosure is designed to protect the antenna radiating structure, including the antenna boards and its circuitry. The cover is made of fiberglass materials. Inside, the cavity is filled with injected echo foam. The entire body is strong and weather resistant, and is designed to withstand a severe outdoor environment.

Antenna Coverage Pattern

The radiating crossed dipole elements of the disclosure antenna are turned on/off by pin diode switches in columns. At a given time, approximately six (6) columns of elements are on and ten (10) columns are off. The off dipole elements are the ones that are not facing the satellite. For the disclosure antenna, a total of forty eight (48) crossed dipole elements are on at a given time. The peak gain of the disclosure antenna is estimated to be 17 DBIC. The vertical and horizontal plane antenna beam widths are estimated to be 10 degrees and 15 degrees respectively. If a lower antenna gain performance is desired, then the number of boards may be reduced so that fewer dipoles will be excited.

Because of the large separation between radiating elements, the backside radiation of the crossed dipole element will interfere with the front side of another radiating element; therefore, it is necessary to provide good isolation between the antenna elements. For this reason, a cavity has been added which enhances the gain performance of individual crossed dipole elements and in turn improves the gain performance of the antenna system.

DRAWINGS

FIG. 1 shows the outer dimensions of the disclosure antenna and the location of all antenna crossed dipole radiating elements. The height of the antenna 1 is 8.50 inches and the diameter 2 is 4.25 inches. The antenna fiber glass cover is 3. The interface mounting bracket is 4.

FIG. 2 shows how the crossed dipole elements are being excited. The crossed dipole elements 5 are individually fed by a 90 degree hybrid coupler 6. The pin diode switch is 7*a*. The input/output ports 7 of the hybrid coupler are connected to their respective left and right hand circular polarization power dividers 8 and 9. The input of each power divider is connected to a diode phase shifter 10. The input side of each phase shifter is connected to an eight way power divider 11, which in turns connected to the respective left hand polarization transmit port 12 and a right hand receiving polarization port 13.

The invention claimed is:

1. An antenna assembly comprised of identical circuit boards that contains crossed dipole elements, hybrid couplers, pin diode switches, power dividers and pin diode phase shifters which are interconnected, perform together as an array to form high gain beams for continuous communication with a satellite while operating on a moving vessel; the assembly further comprising of circuit boards of circular shape which fits into a tubular body in a modular fashion; the preferred embodiment example is comprised of eight boards; each circuit board is excited by two coaxial lines, and one is for right while the second coaxial line is for left-hand circular polarization for receiving and transmitting of communication signals; leading from coaxial cable is a pin diode phase shifter which connected to a spoke-wheel type of power divider that has sixteen outputs while each output line is connected to a pin diode switch which in turn connects to a quadrature hybrid coupler and then to a cavity backed crossed dipole radiating element; the two coaxial lines from each circuit board are each connecting to their respective left and right hand eight way power dividers where all parts performing together, forms the disclosure antenna assembly.

2. The antenna assembly, according to claim 1, consists of eight circuit board and each circuit board is excited a group of 16 cavity backed crossed dipole elements that are located near the outer edge of the circuit board.

3. The antenna assembly, according to claim 1, consists of quadrature hybrid couplers and each crossed dipole element is connected to a coupler unit.

4. The antenna assembly, according to claim 1, consists of eight circuit boards and each board consists of a spoke-wheel type of power divider of sixteen arms and the output of each arm is connected to a pin diode switch which in terns connected to a quadrature hybrid coupler onto the crossed dipole element.

5. The antenna assembly, according to claim 1, consists of pin diode phased shifters which are connected between the spoke-wheel power dividers and the eight ways power dividers.

6. The antenna assembly, according to claim 1, consists of devices that are operating as an array and forms an antenna beam continuously pointing at a satellite while the antenna is operating on a moving vessel.

7. The antenna assembly, according to claim 6, consists of six (6) columns of crossed dipole elements that are turned on while ten (10) columns of crossed dipole elements are turned off at a given time; the six columns of radiators that are visible to the satellite are turned on and a total of forty (48) radiators are turned on at a given time; the pin diode switches are applied to turn off the radiating elements that are not visible to the satellite.

8. The antenna assembly, according to claim 6, will operate the circuit board phased shifter in a manner such that the antenna beam is pointing along the vertical direction to a satellite.

* * * * *